United States Patent [19]

Stadler et al.

[11] Patent Number: 4,867,061

[45] Date of Patent: Sep. 19, 1989

[54] PENETRATOR AND METHOD FOR THE MANUFACTURE THEREOF

[76] Inventors: Hansjörg Stadler, Tucherstrasse 23, 8501 Rückersdorf; Klaus von Laar, Hans-Sachs-Strasse 74, 8560 Lauf, both of Fed. Rep. of Germany

[21] Appl. No.: 151,710

[22] Filed: Feb. 3, 1988

[30] Foreign Application Priority Data

Feb. 20, 1987 [DE] Fed. Rep. of Germany ..... 3705382

[51] Int. Cl.[4] ..... F42B 1/02

[52] U.S. Cl. ..... 102/307; 102/476

[58] Field of Search ..... 102/307, 476

[56] References Cited

U.S. PATENT DOCUMENTS

| | | | |
|---|---|---|---|
| 4,441,428 | 4/1984 | Wilson | 102/307 |
| 4,463,678 | 8/1984 | Weimer et al. | 102/307 |
| 4,498,395 | 2/1985 | Kock et al. | 102/517 |
| 4,499,830 | 2/1985 | Majerus et al. | 102/476 |
| 4,551,287 | 11/1985 | Bethman | 264/3 R |
| 4,598,643 | 7/1986 | Skrocki | 102/307 |
| 4,613,370 | 9/1986 | Held et al. | 102/306 X |
| 4,702,171 | 10/1987 | Tal et al. | 102/476 |
| 4,766,813 | 8/1988 | Winter et al. | 102/307 |

*Primary Examiner*—Peter A. Nelson

*Attorney, Agent, or Firm*—Scully, Scott, Murphy & Presser

[57] ABSTRACT

A penetrator which is constituted of a heavy-metal, for example, a metal such as tungsten or depleted uranium, and which possesses a differently designed tensile strength and ductility along its length; and a method of manufacturing the penetrator. The penetrator is constituted of a single-crystal of the heavy-metal. The penetrator can be constituted from tungsten; however, it can also be constituted of an alloy whose main component is tungsten, to which rhenium is alloyed.

11 Claims, 1 Drawing Sheet

PENETRATOR AND METHOD FOR THE MANUFACTURE THEREOF

BACKGROUND OF THE INVENTION

1. Field of the Invention

The present invention relates to a penetrator which is constituted of a heavy-metal, for example, a metal such as tungsten or depleted uranium, and which possesses a differently designed tensile strength and ductility along its length. Moreover, the invention pertains to a method of manufacturing the penetrator.

2. Discussion of the Prior Art

Penetrators, which are employed as inertial projectiles for the attacking of armor, have already been known for a lengthy period of time. The penetrators are produced as lengthy slender members constituted from a heavy material, and are fired with a propulsion mechanism. For purposes of stabilization, the penetrators incorporate a guidance mechanism at their tail end. A penetrator of this type is already known from the disclosure of European Pat. No. O 143 775 A 2 and possesses a varying tensile strength and ductility along the extent of its length. A construction or design for a penetrator of that type is proposed on the basis of the recognition that the penetrator above all possess a high tensile strength in its forward region, in contrast therewith, a high ductility in its middle region, and again an increasing tensile strength in the region of its tail end. This construction, in general, serves for increasing the piercing power of the penetrator. The high strength at the tip of the penetrator is required so that the penetrator will not exceedingly deform during penetration into the target, its ductility in the middle region is designed to prevent the penetrator from breaking in the middle upon an included or angled striking against the target, and the increasing tensile strength at the tail end region is necessary for containing the forces which are encountered therein during the firing of the penetrator.

SUMMARY OF THE INVENTION

Accordingly, commencing from the current state-of-the-technology, it is an object of the present invention to provide a penetrator and a method for the manufacture thereof, in which there can be set the different material properties along its length with a good breadth of variability.

In order to achieve the foregoing object in conformance with the invention, it is contemplated that the penetrator be constituted of a single-crystal of the heavy-metal.

The penetrator can be constituted of a single element, preferably tungsten; however, in the preferred embodiment of the invention, it can also be constituted of an alloy whose main component is tungsten, to which rhenium is alloyed.

A further modification of the invention, as well as possible manufacturing methods for the penetrator, can be ascertained from the detailed description as set forth hereinbelow. An alloy which is constituted of tungsten and rhenium possesses the advantage that, at already lower temperatures, it is more ductile than pure tungsten. Consequently, there is obtained a lower degree of brittleness; in essence, a higher ductility of the material which, above all, is important for the middle portion of the penetrator. A single-crystal, inasmuch as it does not possess any grain boundaries, evidences a significantly better behavior under high-speed deformation than usual polycrystalline materials. This is elucidated in further detail hereinbelow.

Single-crystals are bodies constituted of chemical elements, alloys and chemical compounds, which are propagated in accordance with specific methods, and in contrast with the polycrystalline bodies which are present in the technology and in everyday life, consist of only a single; however, possibly large crystal. Hereby, this relates to chemically highly-pure bodies which in their behavior extensively conform to the theoretical behavior of the pure crystal of the applicable element. These single-crystalline bodies are anisotropic, do not possess any grain boundaries, such as would be the case for polycrystalline bodies, and their strength as well as their modulus of elasticity are in certain crystal orientations significantly higher than would be the case for a polycrystalline material.

Single-crystals can be produced from not only pure elements, but they can also be produced from alloyed metals. In accordance with the type of element or alloy, they evidence a more or less distinct anisotropy, which signifies that their properties are different along the crystal orientations [100], [110] and [111]. These properties are, for example, the modulus of elasticity, the tensile strength or the limiting stress under deformation. For copper, which, as an example, possesses an extremely distinctive anisotropy, the moduli of elasticity upon loading or being stressed in the direction of the above-mentioned crystal orientations, are respectively approximately 6800, 12,000 and 18,000 kp/mm$^2$.

Basically, the following requirements are placed on penetrators, which can be particularly satisfactorily fulfilled by single-crystalline bodies. These requirements are a good modulus of elasticity, in order to achieve the greatest possible elastic and least possible plastic deformation upon impact; and furthermore, the high tensile strength at the tip of the penetrator as well as a high yield stress.

Inasmuch as single-crystals, in contrast with polycrystalline metals, are not produced through the usual deformation methods, but rather through propagation, when the method of propagation is suitably configured, there are obtained broader possibilities of undertaking the adjustment of the properties of the material over the length of the body. On the one hand, these possibilities consist in the utilization of the anisotropy of the single-crystal; in effect, the different distinctiveness of its properties in the various crystal orientations, and on the other hand, in the alloying therein of further materials over a portion of the length of the body, or in the alloying with a linear or variable gradient of the material alloyed thereto. Consequently, it is thus important that during the propagation of single-crystals, the initially present crystal orientation of the body can be changed, but, however, through the alloying thereto of one or possibly even more elements, there can be produced an alloy which forms a smooth transition to that portion of the body which is constituted of the pure main constituent of the metal or of a lesser alloyed part.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 1:
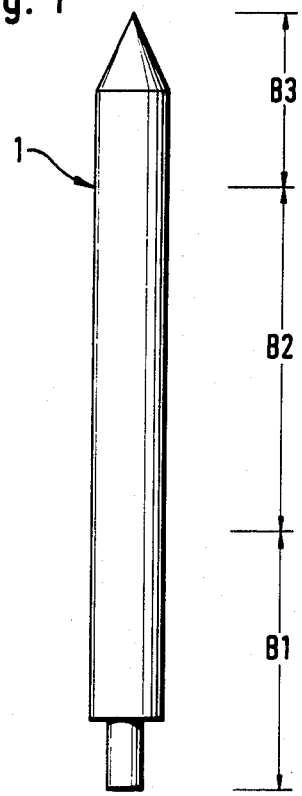
FIG. 1 illustrates a generally schematic representation of a penetrator, shown without a propulsion mechanism and guidance mechanism.

In FIG. 1 there is schematically illustrated a penetrator 1 which is constituted of either pure tungsten or, possibly, from an alloy constituted of tungsten and rhenium. The tungsten may comprise 80 to 99.8% by weight and the rhenium 20 to 0.2% by weight. Within the context of the invention, it would also be possible to utilize depleted uranium. The distinctiveness consists of in that this penetrator is propagated as a single-crystal and along its length possesses different properties in regions B1, B2 and B3 with respect to its tensile strength and ductility.

Figure 2:
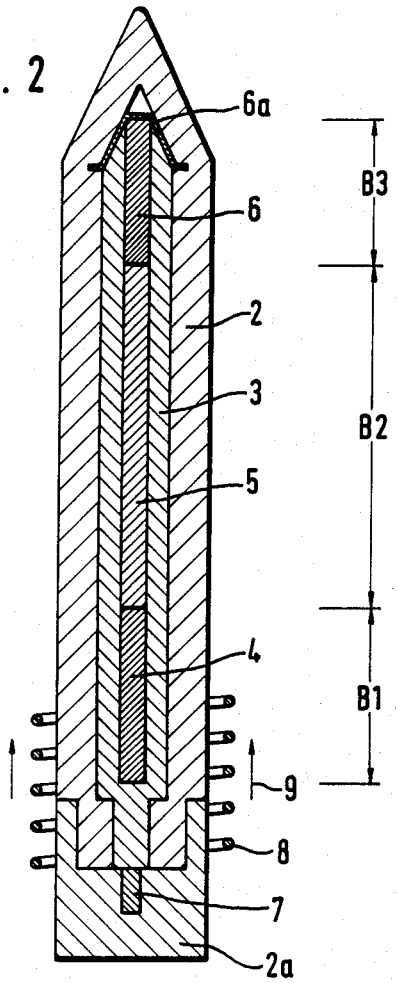
FIG. 2 illustrates in a generally schematic longitudinal sectional view, a worktool for the manufacture of the penetrator pursuant to a first manufacturing method.

In FIG. 2 there is illustrated a worktool for the production of a penetrator which is constituted from a single-crystal, in which the penetrator has its middle region B2 constituted of an alloy of tungsten and rhenium. The worktool which is illustrated in an extensively schematic configuration, is constituted of a heat-resistant crucible 2, whose internal shape conforms with that of the penetrator, and a worktool 2*a* in the bottom region of the crucible. Within this crucible there is provided a hollow member 3 which is constituted of pure tungsten and which has rod-shaped members 4, 5 and 6 inserted therein, whose composition can be varied in conformance with the desired results. In the present instance, the rods 4 and 6 are each constituted of pure tungsten, and the rod 5 of a prealloy of tungsten and rhenium. It is, however, contemplatable that the rods 4 and 6 are constituted of a hardener or key alloy possessing a lower rhenium content. This capability is selected when a higher ductility is to be imparted to the penetrator at its tip and at its tail end than would be possible with pure tungsten. The rod 6 is anchored by means of retainer 6*a* in the tip of the crucible 2.

At the bottom of the crucible, a crystal seedling 7 is arranged in a worktool 2*a*, which seedling is constituted of a tungsten single-crystal and which possesses such an orientation of the crystal axis; for example [100], which is to be that of the subsequent single-crystal formed body. Reference numeral 8 finally identifies the windings of a coil to which there is applied an electrical HF-field for the heating of the crucible. This HF-coil 8 is displaceable along the crucible 2 in the direction of the arrows 9, and causes the melting of the hollowing body 3 as well as that of the rods 4 through 6. The melting process begins in the illustrated bottom position of the coil and leads to the melting of the lowest portion of the hollow body 3 as well as the upper portion of the seedling 7. Hereby, the body 3 assumes, beginning from the bottom, the crystal orientation of the seedling 7, whereby this crystal front propagates upwardly. At this location the single-crystal already forms itself. In accordance with the propagation of the growth front, the coil 8 is conducted upwardly in the direction of arrows 9, and thereby the growth front is always displaced further in a direction towards the tip of the hollow body 3. Due to the applied HF-field, the material of the rods 4 through 6 uniformly swirls itself together with that of the hollow body 3 in a horizontal direction. In the present instance, in the region B2 of the entire penetrator there is built-up an alloy consisting of tungsten and rhenium. At the boundaries between the regions B1 and B3 there is encountered a smooth transition in the composition of the material. The crucible 2 increasingly emerges from the coil during the displacement of coil 8, and cools down. As soon as this has happened, the seedling 7 is removed and the crucible 2 is opened. The applicable technology for such worktools is known, and is not described herein in further detail. The resultant penetrator is already present in its final shape and does not require any further processing or treatment. Through the sequential melting, in which the coil is always moved in the same direction; however, with the crucible being pivoted through an angle of 180°, there can similarly be influenced the change in the properties over the length of the penetrator.

Figure 3:
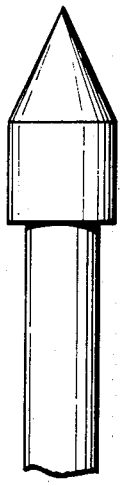
FIG. 3 illustrates a possible shape of the penetrator constituted of a single-crystal as an intermediate or semi-finished product.

When it is desired to impart a particularly high strength to the tip of the penetrator, then it is possible to configure the crucible 2 in the region of its tip so as to produce a penetrator having the form as shown in FIG. 3. In this instance, it is necessary to compress the tip of the penetrator, which can be carried out, for example, through careful hammering or forging. However, in that case, the single-crystal loses its single-crystalline formation at the surface in the region of its tip, without the forming of any grain boundaries, as a result of which a part of the higher strength achieved by the compression of deformation is again dissipated through the poorer properties of the crystal.

Figure 4:
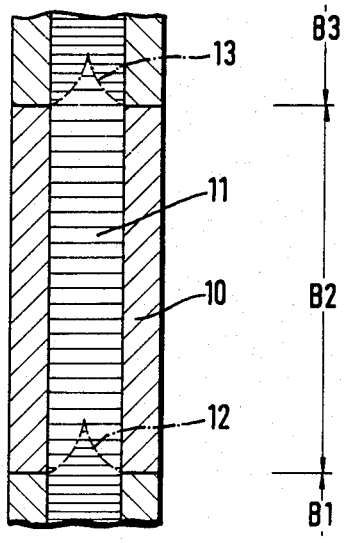
FIG. 4 illustrates a partial longitudinal sectional view of the worktool for the manufacture of a penetrator pursuant to a second manufacturing method.

In FIG. 4 there is represented a further possibility for producing a penetrator from a single-crystal, wherein the body 11 which is inserted into the worktool 10 is constituted from either the pure metal or; however, from a key alloy; for instance, tungsten and rhenium. The particular distinction in this instance resides in that the wall of the crucible is differently shaped in the three regions B1, B2 and B3. In the region B1, the crucible wall is the same as that of the worktool shown in FIG. 2. In the region B2, the crucible wall has an active surface of the first type, which causes the molten metal to epitactically grow from the wall of the crucible and to assume the orientation of the crucible wall. When the orientation of the crucible wall in the region B2 conforms, for example, to a crystal orientation [100], and the crystal which is propagated in the region B1 possesses a crystal orientation [111] as in the case of FIG. 2, there is then formed an orientation front 12 along which there is effected a transition in the orientation of the crystal from [111] to [100].

In the region B3, the crucible wall is similarly formed as an active surface, however, of a second type. With respect to the desired strength of the penetrator at its tip, the orientation of the crucible surface is formed in conformance with the crystal orientation [111], and causes the growing crystal to change after the orientation front 13 from a crystal orientation [100] into a crystal orientation [111]. The melting of the crystal is hereby effectuated in the same manner as in the arrangement pursuant to FIG. 2.

Through the variation of the crucible wall, the crystal growth can be changed in its orientation, and as a result, the properties of the strength of the crystal can be varied along its length.

In addition to a manufacturing method pursuant to FIGS. 2 and 4, which in its basic form was developed by Bridgman, within the scope of the invention it is also possible to contemplate utilization of the known zonal melting process in which the crucible is eliminated and the HF-coil is conducted directly along the metal body.

What is claimed is:

1. A penetrator which is constituted of a heavy-metal, said penetrator possessing a strength and ductility varying along the length thereof; said penetrator being constituted of a single-crystal of said heavy-metal.

2. A penetrator as claimed in claim 1, wherein the single-crystal is constituted of an alloy comprising tungsten as the main component.

3. A penetrator as claimed in claim 2, wherein rhenium is utilized as an alloying element.

4. A penetrator as claimed in claim 3, wherein the penetrator is constituted of 80 to 99.8% by weight of tungsten and 20 to 0.2% by weight of rhenium.

5. A penetrator as claimed in claim 1, wherein said penetrator has a thickened tip imparted thereto duing propagation of the single-crystal for the purpose of subsequent compression.

6. A method for the manufacture of a penetrator which is constituted of a heavy-metal, selected from a member of the group consisting of tungsten or depleted uranium and which possesses a strength and ductility varying along the length of the penetrator; comprising charging a hollow body constituted of said heavy-metal generally having external dimensions and a shape of the penetrator with a key alloy constituted of said heavy-metal, in which in the middle portion of the penetrator includes a higher proportion of metal to form said alloy; conveying and melting the hollow body within a crucible-shaped worktool having an internal shape conforming to the penetrator from a crystal seedling arranged in the bottom of the worktool in a direction towards the tip through a high-frequency field; slowly cooling said body after emerging from the high-frequency field; and separating said cooled body from the crystal seedling.

7. A method for the manufacture of a penetrator which is constituted of a heavy-metal selected from a member of the group consisting of tungsten or depleted uranium and which possesses a strength and ductility varying along the length of the penetrator; comprising introducing a body constituted of an alloy of said heavy metal into a crucible-shaped worktool having an internal shape in conformance with the penetrator, a single-crystal seedling having a crystal axis orientation [111] being arranged at the bottom of the worktool, a high-frequency coil being dispaced relative to the worktool for the melting of the body along the worktool from the seedling, the crucible wall acting over a portion of the length thereof on the growth of the crystal such that the growth which is initially influenced by the seedling in the orientation of axis [111], commencing from the formation of the crucible wall in a middle region thereof forms a smooth reorientation of the crystal axis of the single-crystal into the orientation [100], and in the region of the tip of the penetrator through a different formation of the crucible wall effects a further smooth reorientation in the direction of the crystal axis [111]; slowly cooling the worktool and the penetrator after emerging from the high-frequency coil; and removing the crystal seedling.

8. The method of claim 6 where said heavy-metal is tungsten.

9. The method of claim 8 where said alloy is an alloy of tungsten and rhenium, and said metal to form said alloy is rhenium.

10. The method of claim 7 wherein said heavy-metal is tungsten.

11. The method of claim 10 where said alloy is an alloy of tungsten and rhenium.

* * * * *

UNITED STATES PATENT AND TRADEMARK OFFICE

CERTIFICATE OF CORRECTION

PATENT NO. : 4,867,061

DATED : September 19, 1989

INVENTOR(S) : Hansjorg Stadler, et al.

It is certified that error appears in the above-identified patent and that said Letters Patent is hereby corrected as shown below:

On the Title page, add section 73 to read:

--[73] Assignee: DIEHL GmbH & Co.--

Signed and Sealed this

Twenty-sixth Day of February, 1991

*Attest:*

HARRY F. MANBECK, JR.

*Attesting Officer*

*Commissioner of Patents and Trademarks*